United States Patent [19]

Jelinek et al.

[11] 4,133,749

[45] Jan. 9, 1979

[54] PROCESS OF SEPARATING SOLID GRANULAR METALLURGICAL PRODUCTS AND THEIR PRECURSORS AND APPARATUS

[75] Inventors: Horst Jelinek, Offenbach; Gerd Elsenheimer, Frankfurt am Main; Bernhard Klersy, Ludwigshafen, all of Germany

[73] Assignee: Metallgesellschaft Aktiengesellschaft, Frankfurt am Main, Germany

[21] Appl. No.: 773,110

[22] Filed: Feb. 28, 1977

[30] Foreign Application Priority Data

Mar. 18, 1976 [DE] Fed. Rep. of Germany ..... 2611401

[51] Int. Cl.[2] ..... B07B 4/08; B07B 1/00

[52] U.S. Cl. ..... 209/24; 209/32; 209/318

[58] Field of Search ..... 209/24–26, 209/27, 32–35, 315, 318, 311–312, 134, 250, 142–143, 2, 12, 295, 321; 302/44

[56] References Cited

U.S. PATENT DOCUMENTS

| | | | |
|---|---|---|---|
| 1,232,947 | 7/1917 | Malm | 209/318 |
| 2,041,591 | 5/1936 | Brown et al. | 209/35 |
| 2,210,103 | 8/1940 | Stoner | 209/12 |
| 2,354,311 | 7/1944 | Harlow | 209/144 |
| 2,765,079 | 10/1956 | Franken | 209/250 |
| 3,044,619 | 7/1962 | Knolle | 209/33 |

FOREIGN PATENT DOCUMENTS

| | | | |
|---|---|---|---|
| 2306412 | 8/1974 | Fed. Rep. of Germany | 209/318 |
| 942995 | 11/1963 | United Kingdom | 209/26 |

*Primary Examiner*—Robert Halper
*Assistant Examiner*—Jon E. Hokanson
*Attorney, Agent, or Firm*—Sprung, Felfe, Horn, Lynch & Kramer

[57] ABSTRACT

A process and apparatus for separating solid granular metallurgical products. A plurality of linearly vibrating screens are housed, one over the other, each inclining more than the one above and each having a smaller mesh opening than the one above and 1.5 to 15 times larger than the desired parting size. The solids are fed onto the uppermost screen at the upper end thereof and are deflected in the direction of inclination of the screen. The finer solids initially fall through freely and on screens having smaller mesh openings and are also deflected in the direction of inclination of the screen. The coarsest solids fraction is withdrawn as overflow from the uppermost screen, finer solids fractions are withdrawn as overflow from following screens, and solids which have passed through all screens are withdrawn as a finest fraction. A gaseous fluid is flowed through at least part of the working space required for screening approximately transversely to the direction in which the solids pass through the screens. The solids having a lower specific gravity are entrained between vertically adjacent screens by the gaseous flow and gaseous fluid laden with the solids of lower specific gravity flow into a separating chamber with the solids being separated from the gas stream in the separating chamber.

14 Claims, 6 Drawing Figures

PROCESS OF SEPARATING SOLID GRANULAR METALLURGICAL PRODUCTS AND THEIR PRECURSORS AND APPARATUS

BACKGROUND

In the metallurgical processing of ores it is often necessary to separate the ores themselves or admixtures as well as intermediate products and final products into individual particle size fractions having the same composition or different compositions. This separation often involves a considerable structural and energy expenditure, which must be minimized.

It is known to effect the separation on a plurality of linearly vibrating screens, which are arranged one over the other and have inclinations which increase from top to bottom whereas the widths of the mesh openings decrease from top to bottom and the width of the mesh openings of each screen is 2 to 15 times larger than the desired parting size. In such case, the material to be separated is fed onto the uppermost screen at the upper end thereof, the coarser solids are deflected in the direction of inclination of the screen, the finer particles initially fall through freely and on screens having smaller mesh openings are also deflected in the direction of the inclination of the screens, the coarsest solids fraction is withdrawn as overflow from the uppermost screen, finer solids fractions are withdrawn as overflow from following screens, and solids which have passed through all screens are withdrawn as a finest fraction (U.S. Pat. No. 2,572,177; "Aufbereitungstechnik," No. 2, 1975, pages 72–75). Whereas that process enables a separation into particle size fractions and involves only a small structural and energy expenditure, it does not enable a separation dependent on the particle size and composition of solids or a recovery of a specified particle size fraction which is virtually free from finest solids.

It is also known to separate solids into particle size fractions on a plurality of inclined plates which are vibrated and have vertically aligned openings which are equal in size and spaced predetermined distances apart. To effect a separation, a gas stream is blown from the lower end of the plates to the upper end thereof so that fine-grained solids on the plates and between the plates are entrained toward the upper end of the plates (British Patent Specification No. 899,449). That process does not enable a separation into exactly defined particle size fractions and results in a relatively small throughput. The large air requirement results in a high energy expenditure, and a separation into fractions differing in composition is not possible.

It is also known to effect a separation on screens through which air flows from below and/or above (British Patent Specification No. 484,757; Opened German Specification No. 2,311,308). Whereas that process enables a separation into two fractions which differ greatly in particle size or a separation into fractions differing in composition, it does not enable a separation into more than two particle size fractions differing in composition or a recovery of a specified particle size fraction which is virtually free from the finest solids.

THE INVENTION

It is an object of the invention to avoid the disadvantages of the known processes and particularly to enable a separation dependent on particle size and composition of material or the recovery of a specified particle size fraction which is virtually free from very small particles and wherein the structural and energy expenditure is minimized.

This object is accomplished according to the invention in that a gaseous fluid is caused to flow through at least part of the working space required for screening approximately transversely to the direction in which solids pass through the screens, solids having a lower specific gravity are entrained between adjacent screens by the gaseous fluid flowing through the working space, gaseous fluid laden with the solids of lower specific gravity is caused to flow into a separating chamber, and solids are separated from the gas stream in said separating chamber.

The phrase "approximately transversely to the direction in which solids pass through the screens" means that the gaseous fluid is introduced horizontally and either at right angles to the direction in which solids pass through the screens or at an angle which differs slightly from a right angle to the direction in which solids pass through the screens. Air may generally be used as a gaseous fluid. An inert gas may be used, when the solids to be separated are to be protected from oxygen, as is the case in the treatment of hot pyrophoric sponge iron. Dependent on the solids feed rate and the composition of the solids, the gas rate and the gas velocity are selected so that the desired separation is effected. In this case, large solid particles having a lower specific gravity can be separated from small solid particles having a higher specific gravity.

According to a preferred feature, the coarser solids contained in the gas stream are separated in the separating chamber and the finer solids are entrained by the gas stream leaving the separating chamber. The entrained finer solids can then be separated from the gas in a succeeding stage. In this way, solids of lower specific gravity can be separated into two fractions which differ in particle size and possibly in composition.

According to a preferred feature, the coarser solids are separated on a plate which is rearwardly and upwardly inclined and has a forward edge that extends approximately parallel to the screen, the coarser solids slide down on the plate and are withdrawn from the lower portion of the separating chamber, and the gas stream and the finer solids entrained thereby are withdrawn from the separating chamber behind the plate. This enables a simple separation.

According to a preferred feature, the parting size between the coarser and finer solids is selected by an adjustment of the inclination and/or height of the plate so that the parting size can be varied in a simple manner.

According to a preferred feature, the separation is effected in that additional gaseous fluid is fed into the separating chamber at a controlled rate, so that the gas velocity in the separating chamber is increased and the separation is effected in accordance therewith.

According to a preferred feature, the gaseous fluid is caused to flow at different rates through the particle size fractions disposed between the screens. Gas is fed at a higher rate between the upper screens. The efficiency of separation is improved in this way.

According to a preferred feature, the different rates of the gaseous fluid are controlled by an adjustment of dampers which precede the working chamber. This enables a simple and effective control.

According to a preferred feature, the solids are fed on the side of the inflowing gaseous fluid. This avoids an ingress of solids of higher specific gravity into the separating chamber even when the difference is small.

The invention will be described more fully and by way of example with reference to the drawings, wherein:

FIG. 1 is a transverse sectional view showing a separating apparatus.

FIG. 2*a* is a sectional view taken on line B—B in FIG. 1 and shows an apparatus which comprises three screens and serves to separate the solids of higher specific gravity into two particle size fractions.

FIG. 2*b* is a sectional view taken on line B—B in FIG. 1 and shows an apparatus which comprises five screens and serves to separate the solids of higher specific gravity into four particle size fractions.

Figure 1:
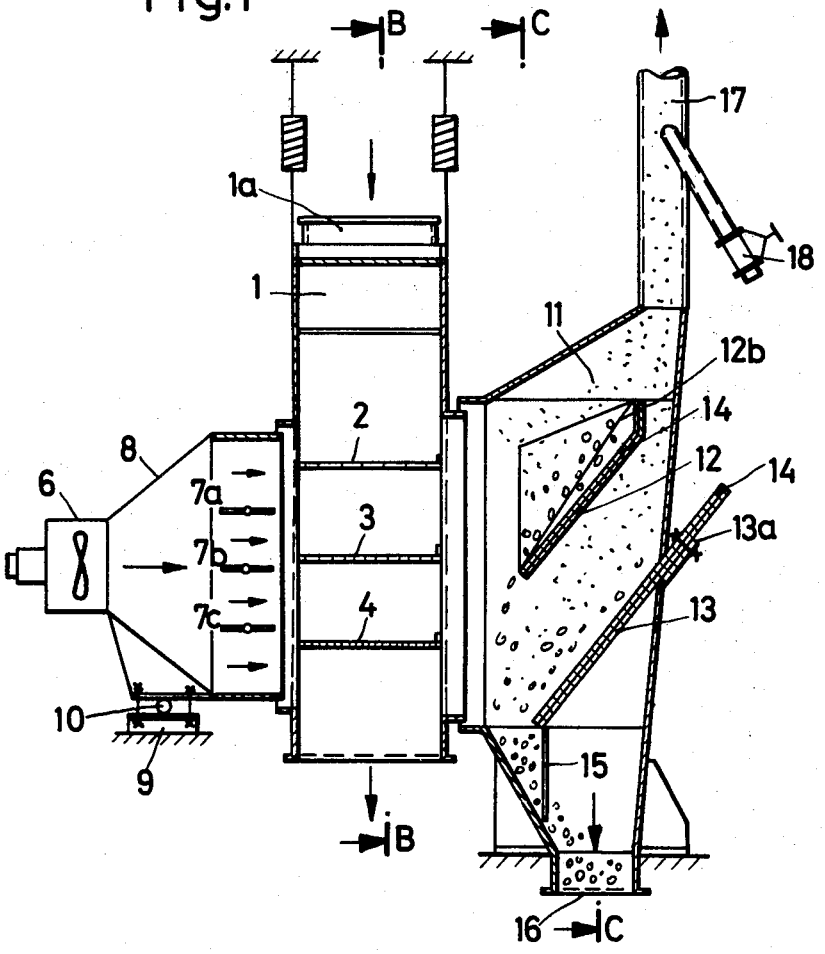
Figure 2A:
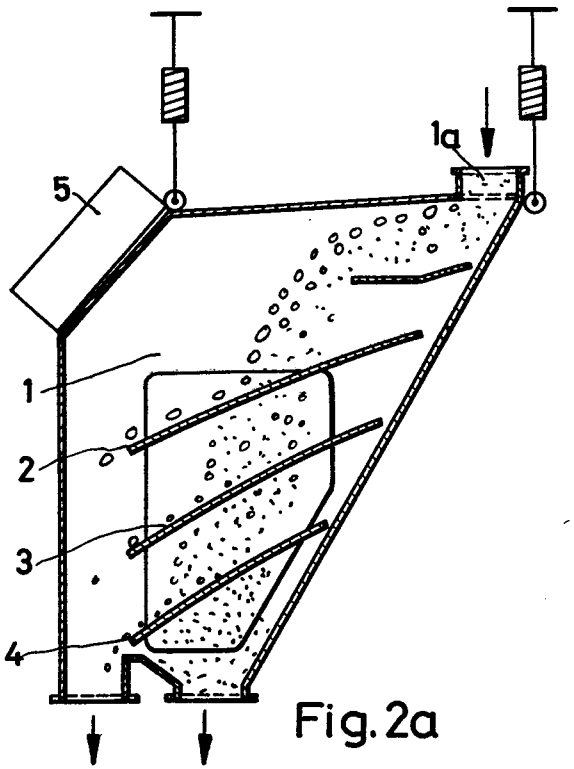

In accordance with FIG. 1, solids charged through an opening 1*a* are separated into different particle size fractions in a housing 1, which is provided with screen bottoms 2, 3, 4, which have mesh openings differing in width and are arranged at different angles, and which is vibrated by an electrically excited motor 5 (FIG. 2*a*). To separate each particle size fraction into solids of higher and lower specific gravity, a gaseous fluid delivered by a blower 6 is blown at a rate which is controlled by a controllable motor or a damper from the side into a housing 8, which is provided with dampers 7*a*, 7*b*, 7*c*, which can be adjusted at different angles. The housing 8 is mounted on a pedestal 9 by means of a swivel joint 10 for adjustment on a vertical axis to different angles relative to the screen housing 1. The dampers 7*a*, 7*b*, 7*c* are substantially parallel to the screen bottoms 2, 3, 4 in FIG. 2*a* and can be adjusted to such positions that each of the working spaces between the screen bottoms 2, 3, 4 can be fed with air at a higher or lower rate.

By the gaseous fluid which is blown by the blower 6 to flow between the dampers 7, the solids of lower specific gravity which have been fed through the opening 1*a* together with the solids of higher specific gravity are separated from the latter as the solids fall through the working spaces between the screen bottoms 2, 3, 4. The solids of lower specific gravity are entrained by the gaseous fluid flowing into the separating chamber 11, which is disposed laterally of the housing 1.

Two separating plates 12, 13 are mounted in this separating chamber. By means of adjusting screws 12*a*, the separating plate 12 is adjustable in height to extend approximately parallel to the screen bottoms 2, 3, 4, so as to enable a preselection of the particle size of the solids of lower specific gravity which are discharged downwardly through the discharge opening 16. The separating plate 12 is bent at a bend line 12*b* so that the coarse solids of low specific gravity are laterally diverted out of the main stream of the gaseous fluid and discharged downwardly through the opening 16. The coarse solids of low specific gravity which have passed through one or more screens impinge on and are deflected by the adjustable (by means of adjusting screws 13*a*) separating plate 13 out of the stream of gaseous fluid. The separating plate 13 is provided with a rubber lip 15, which seals the discharge opening 16 from the separating chamber.

The separating plates 12 and 13 can be adjusted so that all or part of the coarse solids of lower specific gravity can also be upwardly entrained through the suction conduit 17. The separating plates 12 and 13 are provided with a covering 14 of fused basalt for protection against wear.

The fine solids of lower specific gravity are entrained by the gaseous fluid flowing under the separating plate 12 and into the suction conduit 17. The rate at which the gaseous fluid is sucked off can be controlled by a valve 18.

EXAMPLE

A pilot plant in accordance with FIGS. 1, 2*a*, 3, 4, and 5 was used to separate a mixture of sponge iron and devolatilized coal. The mixture of sponge iron and devolatilized coal had been produced by direct reduction in a rotary kiln. The materials had the following characteristic data:

| Chemical Analysis of Sponge Iron | |
|---|---|
| $Fe_{tot}$ | 95.0% |
| $Fe_{met}$ | 89.7% |
| S | 0.013% |
| C | 0.30% |
| **Chemical Analysis of Devolatilized Coal** | |
| $C_{fix}$ | 46.4% |
| Ash | 53.6% |

| Sieve Analysis of Sponge Iron | | Sieve Analysis of Devolatilized Coal |
|---|---|---|
| + 25 mm | 0.4% | |
| 20 - 25 mm | 1.8% | |
| 18 - 20 mm | 2.2% | |
| 15 - 18 mm | 8.9% | |
| 12 - 15 mm | 12.4% | |
| 10 - 12 mm | 15.9% | 0.9% |
| 8 - 10 mm | 14.8% | 2.0% |
| 6 - 8 mm | 16.0% | 18.5% |
| 3 - 6 mm | 19.0% | 14.5% |
| 1 - 3 mm | 5.7% | 34.7% |
| − 1 mm | 2.9% | 29.4% |
| Bulk density | 2.2 kg/l | 0.4 kg/l |

The mixed feed consisted of 91% sponge iron and 9% devolatilized coal. The screening apparatus was provided with screens 2, 3, 4, (FIG. 2*a*) for a separation with parting sizes of 1 mm, 3 mm, and 8 mm. The solids of higher specific gravity (sponge iron) were discharged downwardly through the two discharge openings (FIG. 2*a*). A major portion of the solids of lower specific gravity (devolatilized coal) was entrained by the air stream flowing into the separating chamber 11 (FIG. 1).

The result of the separation is indicated by the following data:

| | | |
|---|---|---|
| Total feed rate into the separating apparatus | 60 | kg/h |
| Sponge iron feed rate | 54.6 | kg/h |
| Coal feed rate | 5.4 | kg/h |
| Sponge iron discharge rate from screening apparatus | 54 | kg/h |
| Coal discharge rate from screening apparatus | 0.1 | kg/h |
| Coarse coal discharge rate from separating chamber 16 (FIG. 2a) | 3.7 | kg/h |
| Fine coal discharge rate through dust duct 17 (FIG. 2a) | 1.6 | kg/h |
| Sponge iron yield 54 kg/54.6 kg = Efficiency of separation of coal | 98.9% | |

-continued

| | |
|---|---|
| and sponge iron 0.1 kg/5.4 kg | 98.1% |

The advantages offered by the invention reside mainly in that a separation dependent on particle size and composition, or the recovery of a specified particle size fraction which is virtually free of very small particles, is enabled. The process is particularly suitable for a separation of solids discharged from a direct reduction process. In that case, the sponge iron, which has a higher specific gravity, is separated from surplus carbonaceous material and admixtures, which have a lower specific gravity. At the same time, a high-carbon fraction can be separated from a low-carbon one.

Figure 2B:
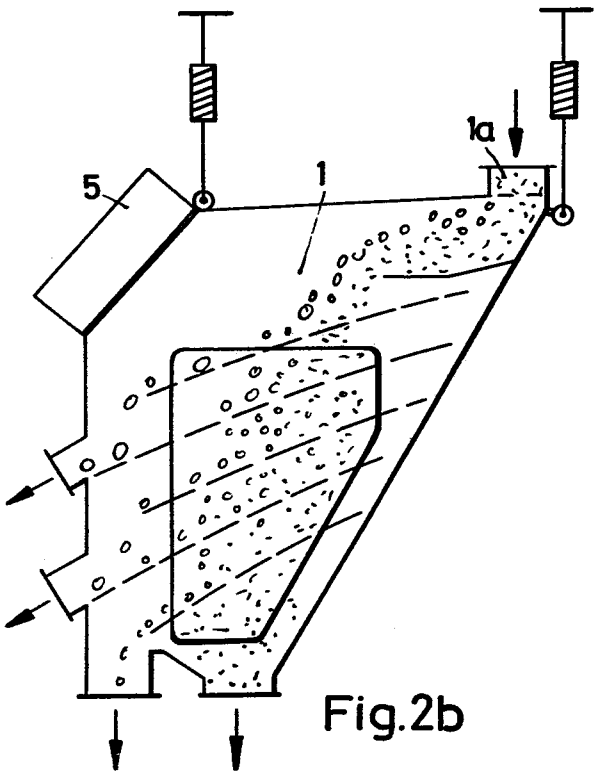
Figure 4:
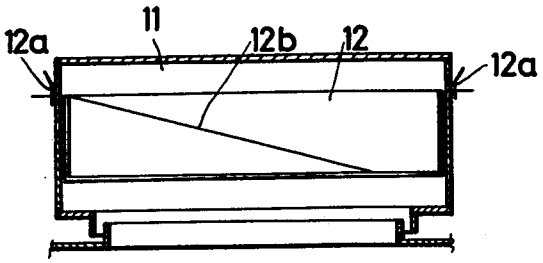
FIG. 4 is a sectional view taken on line D—D in FIG. 3 and showing the separating chamber with the upper separating plate disposed therein.
Figure 5:
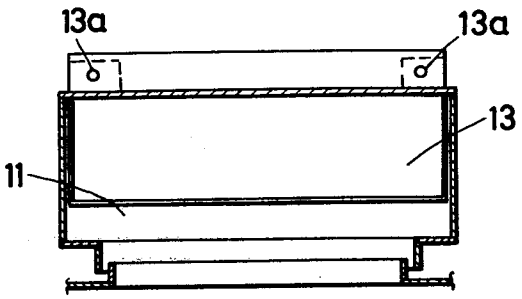
FIG. 5 is a sectional view taken on line E—E in FIG. 3 through the separating chamber and showing the lower separating plate disposed therein.
Figure 3:
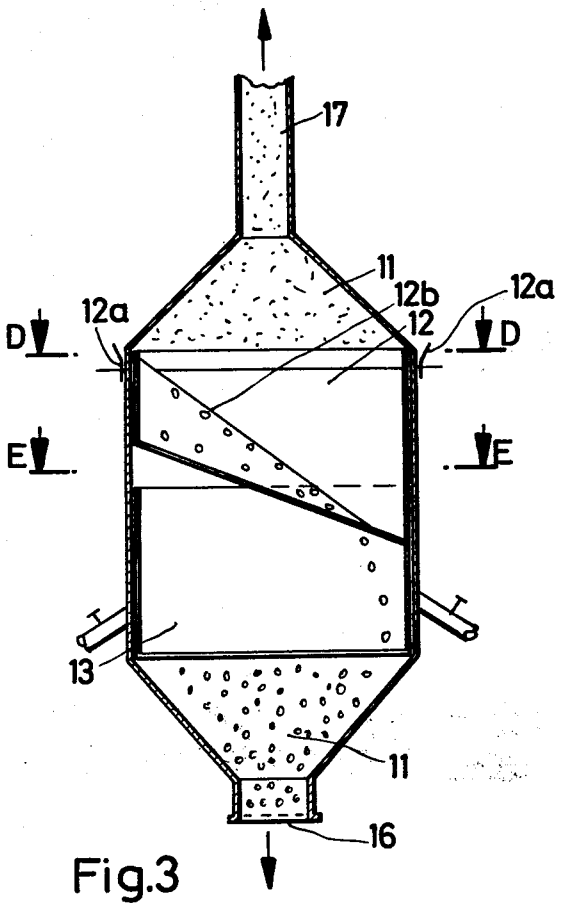
FIG. 3 is a sectional view taken on line C—C in FIG. 1 and shows how the coarse solids of low specific gravity are separated from the gaseous fluid in the upper portion of the separating chamber and discharged downwardly.

The embodiment shown in FIG. 2*b* comprises five screens, shown by dotted lines only, serving to separate the solids of higher specific gravity into four particle size fractions which are discharged at the discharge openings specified by the four arrows, respectively. This is accomplished by having the second and fourth screens extend to the bottom of their respective discharge openings. The remaining features of the invention are otherwise the same as described above.

It will be appreciated that the instant specification and examples are set forth by way of illustration and not limitation, and that various modifications and changes may be made without departing from the spirit and scope of the present invention.

What is claimed is:

1. In a process of separating solid granular metallurgical products and their precursors by providing a plurality of linearly vibrating inclined screens spatially arranged one over the other, in a housing, each screen having an inclination greater than that of the screen above and wherein the width of the mesh openings in each screen is less than that of the screen above and the width of the mesh openings of each screen is 1.5 to 15 times larger than the desired parting size, and feeding the solids to be separated onto the uppermost screen at the upper end of said housing, the coarser solids being deflected in the direction of inclination of said uppermost screen, the finer solids initially falling through freely and onto lower screens having smaller mesh openings being deflected also in the direction of inclination of said lower screens, the coarsest solids fraction being withdrawn as overflow from said uppermost screen, finer solids fractions being withdrawn as overflow from following screens, and solids which have passed through all screens being withdrawn as a finest fraction, the improvement which comprises flowing a gaseous fluid through at least part of the working space required for screening in a direction approximately transverse to the direction in which said solids pass through said screens at a rate and in an amount to effect entrainment of those solids having a lower specific gravity between successive adjacent screens by said gaseous fluid flowing through said working space and to effect the resulting gaseous fluid laden with said solids of lower specific gravity to flow into a separating chamber, and separating at least the coarser of said solids of lower specific gravity from the flowing gaseous fluid in said separating chamber, wherein said separating step includes providing a separating plate in the separating chamber which is rearwardly and upwardly inclined and has a forward edge extendible generally parallel to the level of each of said screens, separating said coarser solids on said plate by sliding same down on said plate and withdrawing same through a discharge opening from the lower portions of said separating chamber, and withdrawing said gaseous fluid and the finer solids entrained thereby upwardly behind said plate through the upper portions of said separating chamber.

2. A process according to claim 1, wherein the separating step includes separating the coarser solids of those contained in the flowing gaseous fluid in said separating chamber with the finer solids entrained by said gaseous fluid leaving said separating chamber.

3. A process according to claim 1, further comprising selecting the parting size between said coarser and finer solids by adjusting at least one of the inclination or height of said separating plate.

4. A process according to claim 1, further comprising providing a flat separating plate in said separating chamber arranged spatially below said separating plate, said flat separating plate having a forward edge extendible generally parallel to each of said screens, deflecting the coarse solids of low specific gravity having passed through one or more of said screens out of the flowing gaseous liquid by impinging on said flat separating plate and sealing said discharge opening in said lower portion of said separating chamber from said separating chamber.

5. A process according to claim 4, further comprising selecting the parting size between said coarser and finer solids by adjusting at least one of the inclination or height of said flat separating plate.

6. A process according to claim 1, further comprising effecting separation by feeding additional gaseous fluid into said separating chamber at a controlled rate.

7. A process according to claim 1, further comprising causing said gaseous fluid to flow at different rates through the particle size fractions disposed in the working space between said screens.

8. A process according to claim 7, wherein the step of causing different flow rates comprises providing an enclosure preceding said housing, passing said gaseous fluid through said enclosure, and providing a plurality of dampers in said enclosure capable of adjusting the rate of flow of said gaseous fluid passing through said enclosure and through said particle size fractions.

9. A process according to claim 1, wherein said gaseous fluid comprises air.

10. A process according to claim 1, wherein said gaseous fluid comprises an inert gas.

11. A process according to claim 1, further comprising feeding said solids to be separated into said housing and directing said solids laterally with respect to the flow of said gaseous liquid.

12. In combination, an apparatus for separating solid granular metallurgical products and their precursors comprising a housing including a plurality of linearly vibrating inclined screens spatially arranged one over the other, wherein each screen has an inclination greater than that of the screen above and the size of the mesh openings in each screen is less than that of the screen above, means for feeding the solids to be separated into said housing and onto said screens whereby said solids pass through said screens in decreasing particle size, a separating chamber in flowing communication with said housing and comprising upper and lower separating plates disposed one above the other, said lower separating plate comprising a flat body, and a discharge opening in the upper and lower portion of said separating chamber, a source of gaseous fluid flowable through said housing between said screens transverse to the direction in which the particles pass through the screens and into said separating chamber to effect entrainment of those solids having a lower specific gravity between adjacent screens and the flowing thereof into said separating chamber, wherein said upper and lower separating plates are disposed rearwardly and upwardly inclined with respect to the gaseous flow and said upper separating plate has a forward edge extendible generally parallel to the level of each of said screens, the coarser solids having lower specific gravity being separable on said upper plate by sliding down said upper plate and being withdrawable through the discharge opening in the lower portion of said separating chamber, said gaseous fluid and the finer solids of lower specific gravity entrained thereby being withdrawable upwardly behind said upper plate through the upper portion of said chamber, the coarse solids of low specific gravity passing through one or more of said screens being impingeable on and deflectable by said lower plate out of said gaseous fluid, said lower plate being provided also with means for separating said discharge opening from said separating chamber.

13. An apparatus according to claim 12, further comprising means for adjusting the inclination and/or height of said upper and lower separating plates to effect selection of the parting size between said coarser and finer solids.

14. An apparatus according to claim 13, wherein an enclosure is provided preceding said housing, said gaseous fluid being passable through said enclosure, a plurality of dampers having means for adjusting the rate of flow of said gaseous fluid through said enclosure and through said solids entrained between said screens and into said separating chamber being provided in said enclosure.

* * * * *